US005249833A

United States Patent [19]

Kobayashi

[11] Patent Number: 5,249,833

[45] Date of Patent: Oct. 5, 1993

[54] ON-VEHICLE DISPLAY DEVICE

[75] Inventor: Takashi Kobayashi, Yokohama, Japan

[73] Assignee: Matsushita Electric Industrial Co., Ltd., Osaka, Japan

[21] Appl. No.: 914,518

[22] Filed: Jul. 17, 1992

[30] Foreign Application Priority Data

Aug. 9, 1991 [JP] Japan ..... 3-200885

[51] Int. Cl.[5] ..... G09F 21/04

[52] U.S. Cl. ..... 296/21; 40/591

[58] Field of Search ..... 296/21; 40/590, 591

[56] References Cited

U.S. PATENT DOCUMENTS

Re. 29,006 10/1976 Coleman ..... 40/588

4,782,615 7/1988 Futatsuishi et al. ..... 40/591

FOREIGN PATENT DOCUMENTS 57-63579 4/1982 Japan .

*Primary Examiner*—Joseph D. Pape

*Attorney, Agent, or Firm*—Stevens, Davis, Miller & Mosher

[57] ABSTRACT

An on-vehicle display device mounted on the bed of a vehicle has a display screen unit which is vertically divided into at least three screens. When the display device is housed, the display screens are disposed in parallel with each other. When the display device is constructed, one of the display screens is moved to the uppermost position, and another is moved to the lowermost position by a horizontal extension hydraulic unit, the remaining screen being moved to an intermediate position by a diagonal extension hydraulic unit, to obtain a very large screen.

3 Claims, 4 Drawing Sheets

ON-VEHICLE DISPLAY DEVICE

BACKGROUND OF THE INVENTION

The present invention relates to a movable onvehicle large display device which can be employed for events such as a horse race, a bicycle race, a concert, a speech meeting and the like, all of which provide many people with image information in a large place.

Such an on-vehicle large display device is installed on the bed of a large vehicle, is moved to a place of a concert, a speech meeting or the like together with the vehicle and is installed therein.

FIG. 1 shows the arrangement of a conventional on-vehicle large display device. In FIG. 1, reference numeral 1 denotes a large vehicle, and reference numeral 2 denotes a display device installed on the bed 7 of the vehicle 1. The display device 2 comprises an upper screen 4 which can be vertically be moved by a vertical extension hydraulic unit 3, and a lower screen 6 which can be horizontally be moved by a horizontal extension hydraulic unit 5 (the left and right in the direction of movement of the vehicle are considered as the front and rear, respectively, hereinafter).

The operation of the device is described below.

FIG. 2A shows a housing state where the upper screen 4 is disposed in front of the lower screen 6. The display device 2 in this housing state is carried by the vehicle 1. When the display device 2 is constructed, the rod 3*a* of the vertical extension hydraulic unit 3 is first extended so that the upper screen 4 is upwardly moved, as shown in FIG. 2B. The lower screen 6 is then pushed forward by the rod 5*a* of the horizontal extension hydraulic unit 5 so as to be disposed below the upper screen 4, as shown in FIG. 2C. The upper screen 4 is moved slightly downward by the vertical extension hydraulic unit 3 so as to be mounted on the lower screen 6 to complete the assembly, as shown in FIG. 2D. The procedure for housing the assembled display device is reverse to that described above.

However, there is a demand for increasing the size of such an on-vehicle large display device. The conventional on-vehicle large display device has a limit with respect to an increase in the size thereof because of the assembly of the upper and lower screens.

SUMMARY OF THE INVENTION

It is an object of the present invention to provide an on-vehicle large display device which enables the construction of a very large screen.

In order to achieve the object, the present invention provides an on-vehicle large display device comprising an upper screen which can be vertically moved by a multistage extension hydraulic unit, an intermediate screen which can be diagonally moved upward and downward by a diagonal extension hydraulic unit and which is disposed below the upper screen upwardly moved, and a lower screen which can be moved horizontally by a horizontal extension hydraulic unit and which is disposed below the intermediate screen upwardly moved.

DETAILED DESCRIPTION OF THE INVENTION

Figure 3:
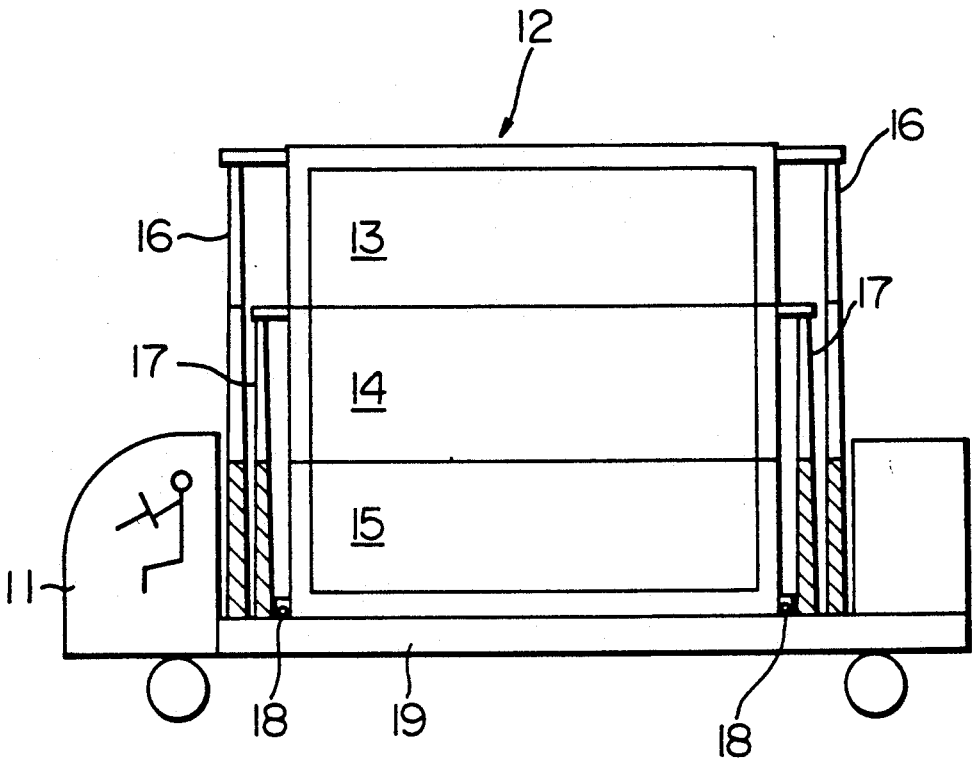
FIG. 3 is a schematic front view showing an on-vehicle display device of the present invention.
Figure 4:
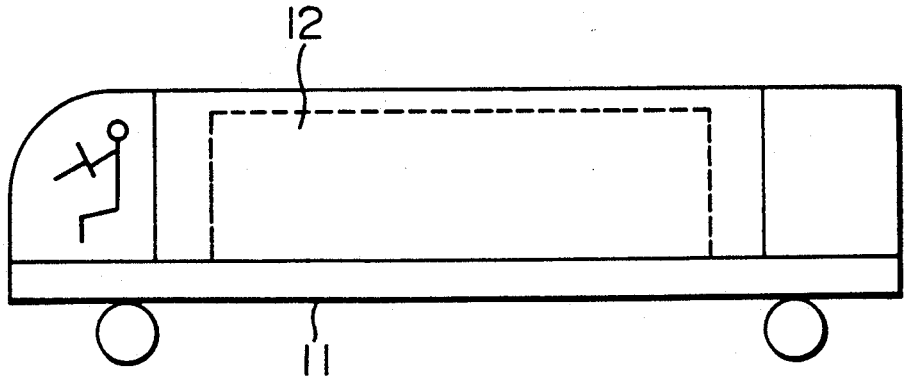
FIG. 4 is a front view showing the state where the device shown in FIG. 3 is housed.

FIG. 3 shows the arrangement of an embodiment of the present invention. In FIG. 3, reference numeral 11 denotes a large vehicle; reference numeral 12, a display device; reference numeral 13, an upper screen; reference numeral 14, an intermediate screen; reference numeral 15, a lower screen; reference numeral 16, a multistage (two-state) extension hydraulic unit for vertically moving the upper screen 13; reference numeral 17, a diagonal extension hydraulic unit for diagonally moving the intermediate screen 14 upward and downward; and reference numeral 18, a horizontal extension hydraulic unit for horizontally moving the lower screen 15. The lower screen 15 is fixed to a bed 19 through a slide mechanism. FIG. 3 shows the state where the display device 12 configured as described above is assembled, and FIG. 4 shows the state where the device is housed.

Figure 5A:
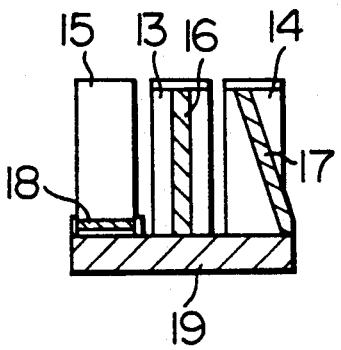
FIG. 5A is a schematic side view showing the state where the device shown in FIG. 3 is stored.

The operation of the above embodiment is described below with reference to the assembly procedure shown in FIGS. 5A to 5E. FIG. 5A shows the state where the device is housed. In this state, the intermediate screen 14 and the lower screen 15 are disposed on the right and left sides, respectively, with the upper screen 13 therebetween. The display device 12 in the housing state is carried by the vehicle 11. Each of the upper, intermediate and lower screens 13, 14, 15 is formed in a thin shape so as to be mounted on the bed 19, as shown in the drawings.

Figure 5B:
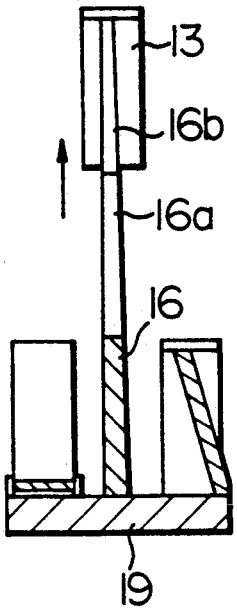
FIGS. 5B to 5F are schematic side views showing the process from the state where the device shown in FIG. 5A is housed to the state where the same device is constructed.
Figure 5C:
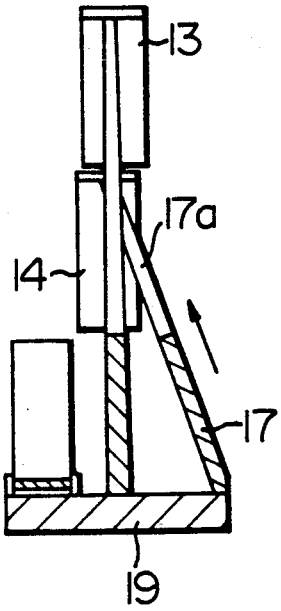
Figure 5D:
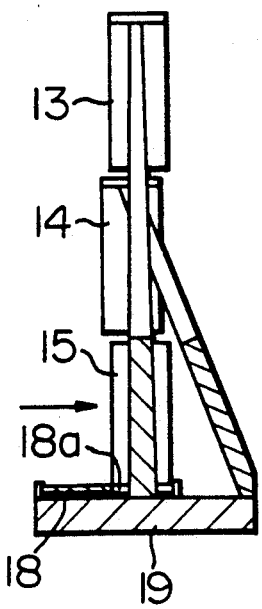
Figure 5E:
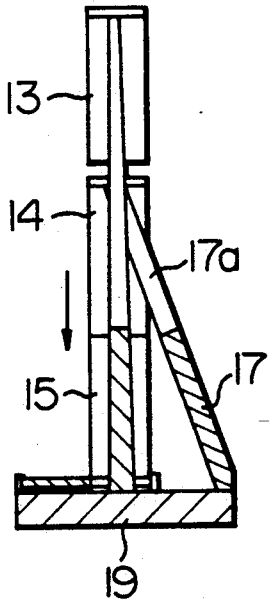
Figure 5F:
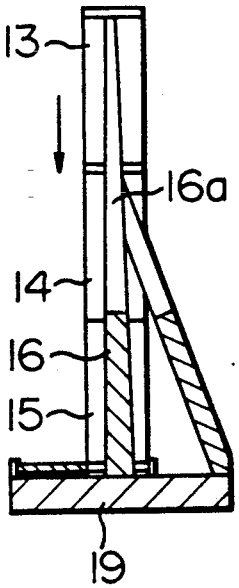

When the display device 12 is constructed, the upper screen 13 is first lifted to the uppermost position by the two-stage rods 16*a*, 16*b* of the multistage extension hydraulic unit 16, as shown in FIG. 5B. As shown in FIG. 5C, the intermediate screen 14 is then diagonally moved upward, by the rod 17*a* of the diagonal extension hydraulic unit 17 which is fixed to the vehicle 11 so as not to fall, to a position slightly higher than the final position of the lower side of the upper screen 13. As shown in FIG. 5D, the lower screen 15 is then slid into the portion below the intermediate screen 14 by the rod 18*a* of the horizontal extension hydraulic unit 18. As shown in FIG. 5E, the intermediate screen 14 is then moved slightly downward so as to be mounted on the lower screen 15 by the rod 17*a* of the diagonal extension hydraulic unit 17. In the final stage, the upper screen 13 is moved slightly downward so as to be mounted on the intermediate screen 14 by the rod 16*a* of the multistage extension hydraulic unit 16 to complete the assembly of a large screen as one unit, as shown in FIG. 5F. The assembled screen may be returned to the housing state in accordance with the procedure reverse to that described above.

Figure 1:
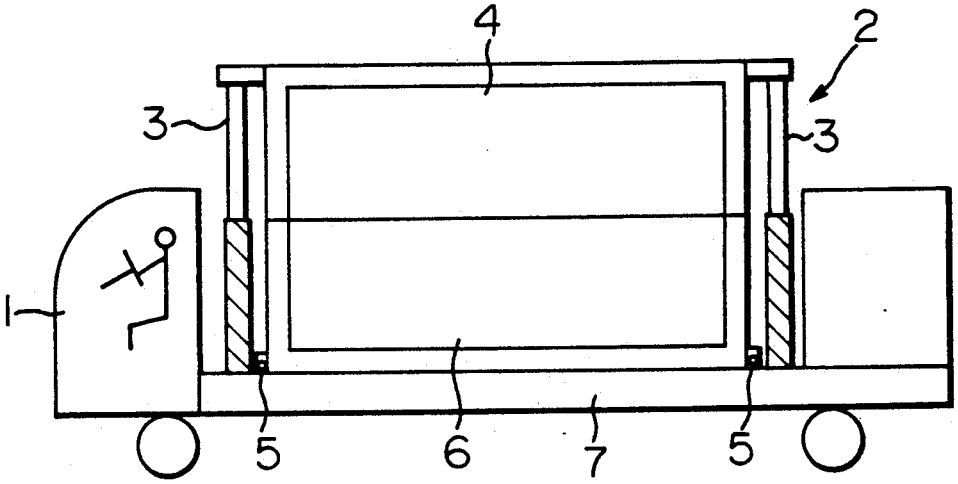
FIG. 1 PRIOR ART
FIG. 1 is a schematic front view showing a conventional on-vehicle display device.
Figure 2A:
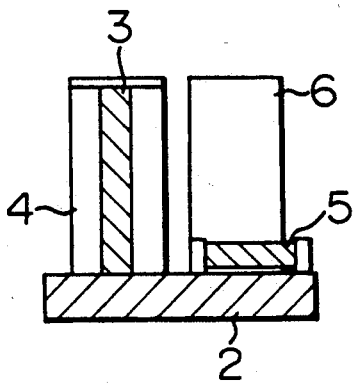
FIG. 2A PRIOR ART
FIG. 2A is a schematic side view showing the state where the device shown in FIG. 1 is housed.
Figure 2C:
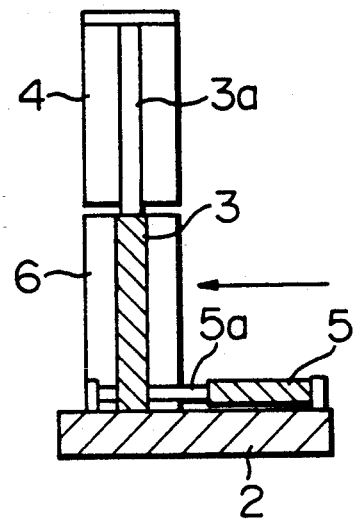
FIG. 2C PRIOR ART
FIGS. 2B to 2D are schematic side views showing the process from the state where the device shown in FIG. 2A is housed to the state where the device is constructed.
Figure 2B:
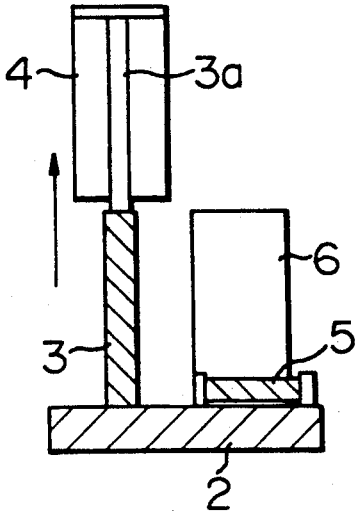
FIG. 2B PRIOR ART
Figure 2D:
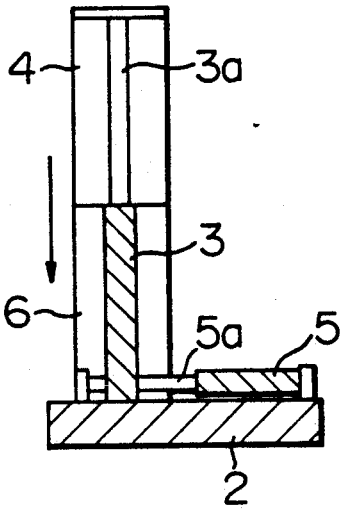
FIG. 2D PRIOR ART

Assuming that the size of each of the screens 13, 14 and 15 is the same as that shown in FIG. 1, the assembled screen has the same width as that shown in FIG. 1 and a height of 1.5 times that shown in FIG. 1. An attempt can thus be made to further increase the size of the screen. Although the length of the vehicle 11 must be increased for increasing the width of the screen, the length can easily be increased. If the width of the screen is increased to 1.5 times, a large screen having a whole size of 2.55 times that shown in FIG. 1 can be obtained.

When the height is further increased, a screen may be further vertically divided into four parts, five parts . . . so as to be inserted between the uppermost screen and lowermost screen by a diagonal extension hydraulic unit having the same structure as that of the above diagonal extension hydraulic unit 17.

As described above, the embodiment of the present invention comprises the upper screen which can be vertically moved by the multistage extension hydraulic unit, the intermediate screen which can be diagonally moved upward and downward by the diagonal extension hydraulic unit and which is disposed below the upper screen upwardly moved, and the lower screen which can be horizontally moved by the horizontal extension hydraulic unit and which is disposed below the intermediate screen upwardly moved. The assembly of the upper, intermediate and lower screens can realize a screen larger than a conventional screen.

What is claimed is:

1. An on-vehicle display device comprising:

an upper screen mounted on a multistage extension hydraulic unit for vertical movement;

an intermediate screen mounted on a diagonal extension hydraulic unit for diagonal upward and downward movement so as to be moveable between an upper and lower position, said intermediate screen being disposed below said upper screen when said intermediate screen is in said upper position; and a lower screen mounted on a horizontal extension hydraulic unit for horizontal movement, said lower screen being disposed below said intermediate screen when said intermediate screen is in said upper position.

2. An on-vehicle display device according to claim 1, wherein said hydraulic units are provided at two ends of said screens.

3. An on-vehicle display device comprising:

a vehicle having a bed;

at least three display screens which extend in a direction of movement of said vehicle and which are disposed on said bed in parallel with each other;

a first extension hydraulic unit for vertically moving a first one of said display screens;

a second extension hydraulic unit for moving a second one of said display screens on said bed in a direction perpendicular to the direction of movement of said vehicle; and a third extension hydraulic unit for diagonally moving a third one of said display screens upward and downward;

wherein when said display device is constructed, said third one of said display screens is disposed by said third extension hydraulic unit between the first one of said display screens vertically moved by said first extension hydraulic unit and the second one of said display screens moved to a position below said first one of said display screens by said second extension hydraulic unit.

* * * * *